United States Patent [19]

Groenendaal, Jr.

[11] Patent Number: 4,816,213

[45] Date of Patent: Mar. 28, 1989

[54] THERMAL DISTORTION ISOLATION SYSTEM FOR TURBINE BLADE RINGS

[75] Inventor: John C. Groenendaal, Jr., Winter Springs, Fla.

[73] Assignee: Westinghouse Electric Corp., Pittsburgh, Pa.

[21] Appl. No.: 92,850

[22] Filed: Aug. 24, 1987

[51] Int. Cl.[4] ..... G21C 15/00

[52] U.S. Cl. ..... 376/402; 415/134; 415/219 R

[58] Field of Search ..... 376/402; 415/134, 136, 415/178, 199.1, 199.4, 199.5, 199.6, 219 R, 219 C

[56] References Cited

U.S. PATENT DOCUMENTS 3,628,884 12/1971 Mierley, Sr. et al. ..... 415/219
3,841,787 10/1974 Scalzo ..... 415/134
3,892,497 7/1975 Gunderlock et al. ..... 415/136
4,699,566 10/1987 Miller ..... 415/219 R
4,701,102 10/1987 Pisz ..... 415/136

*Primary Examiner*—Donald P. Walsh

[57] ABSTRACT

In a nuclear or fossil steam turbine, a novel arrangement of structural elements is utilized to support a stationary blade ring, that is normally supported on a radial wall of a turbine inner casing, on an upstream separate blade ring. Thus, the stationary blade ring is separated from undesirable thermal deformations that naturally occur in turbine inner casing structures. A downstream stationary blade ring is fit to the upstream separate blade ring to maintain its relative position, and is attached using connection bolting and alignment pins or dowels. The inventive system is compact, low cost, and reduces bladepath seal leakage, leading to improved heat rate.

16 Claims, 2 Drawing Sheets

THERMAL DISTORTION ISOLATION SYSTEM FOR TURBINE BLADE RINGS

BACKGROUND OF THE INVENTION

1. Field of the Invention

The field of the present invention is nuclear or fossil fuel steam turbines. More particularly, this invention relates to a system for minimizing thermal distortion of low pressure steam turbine stationary blade rings.

2. Description of the Prior Art

Steam turbines have established a wide usefulness as prime movers, and they are manufactured in many different forms and arrangements. Most steam turbines in use today consist of multiple stages, typically 4–12 stages. The turbine stage consists of a stationary set of blades, often called nozzles, and a moving set adjacent thereto, called buckets, or rotor blades. These stationary and rotating blades (typically 60–140 per ring) act together to allow the steam flow to do work on the rotor, which can be transmitted to the load through the shaft on which the rotor assembly is carried.

Despite their many advantages, there are a number of items that lead to inefficiencies in steam turbines. These include friction losses in both the stationary blades and the rotor blades, rotation loss of the rotor, leakage loss between the inner circumference of the stationary blade and the rotor and between the tip of the rotor blades and the casing, and moisture and super-saturation losses if the steam is wet. Another problem encountered in these types of turbines is that of thermal deformation. Most steam turbines are constructed with at least a single upper casing and lower casing, each having radially inwardly extending ribs and including halves of the stationary blade rings and a series of stationary blades. (Others provide a double casing system.) When the two halves of these casings are formed around the central rotor with its rotating blades, they are typically joined together using a horizontal joint flange. Generally, however, the stationary rings are not bolted together, relying instead upon their attachment to the casing and upon the use of steam sealing keys-strips of a metal, such as steel, used to close the gap between blade ring halves.

The horizontal joint flange used to connect the casing halves is a major source of non-axisymmetric thermal deformation during normal operation of the turbine. When subjected to normal hot operating conditions, the hot inlet region of the turbine expands outwardly in all directions against the casing and the casing against the horizontal joint flange. The horizontal joint flange, being the major point of discontinuity along the casing surface, deforms differently than the casing itself and, being joined to the upper and lower portions of the casing, pulls outwardly on the casing ends and pushes inwardly on the center region.

The variety of thermal distress factors lead to problems of fatigue-cracking and bolt breaking in addition to deformation inefficiencies. Because of these problems, it is desirable to isolate, as far as possible, the stationary blade rings from the inner casing. This is particularly true when there is a single inner casing since, in such a case, the blade rings are less isolated from damaging heat gradients than if there were a double casing.

Accordingly, there exists a need for a method or apparatus that can minimize the thermal distortion of stationary blade rings within steam turbines.

SUMMARY OF THE INVENTION

The present invention is directed to a novel arrangement of structural elements to support a stationary blade ring within a steam turbine. A stationary blade ring of the type that is normally supported on a turbine inner casing is, according to the present invention, supported on an upstream separate blade ring and fit to maintain position, thus separating the subject blade ring from undesirable thermal deformations that naturally occur in the turbine inner casing structure.

Accordingly, it is an object of the present invention to provide an arrangement of structural elements that isolates a stationary blade ring used in a steam turbine from undesirable thermal deformations. Advantages of the present invention includes compactness, low cost, and reduced blade path seal leakage leading to heat rate improvement.

This and further objects and advantages will be apparent to those skilled in the art in connection with the detailed description of the preferred embodiments set forth below.

DETAILED DESCRIPTION OF THE PREFERRED EMBODIMENTS

Figure 1:
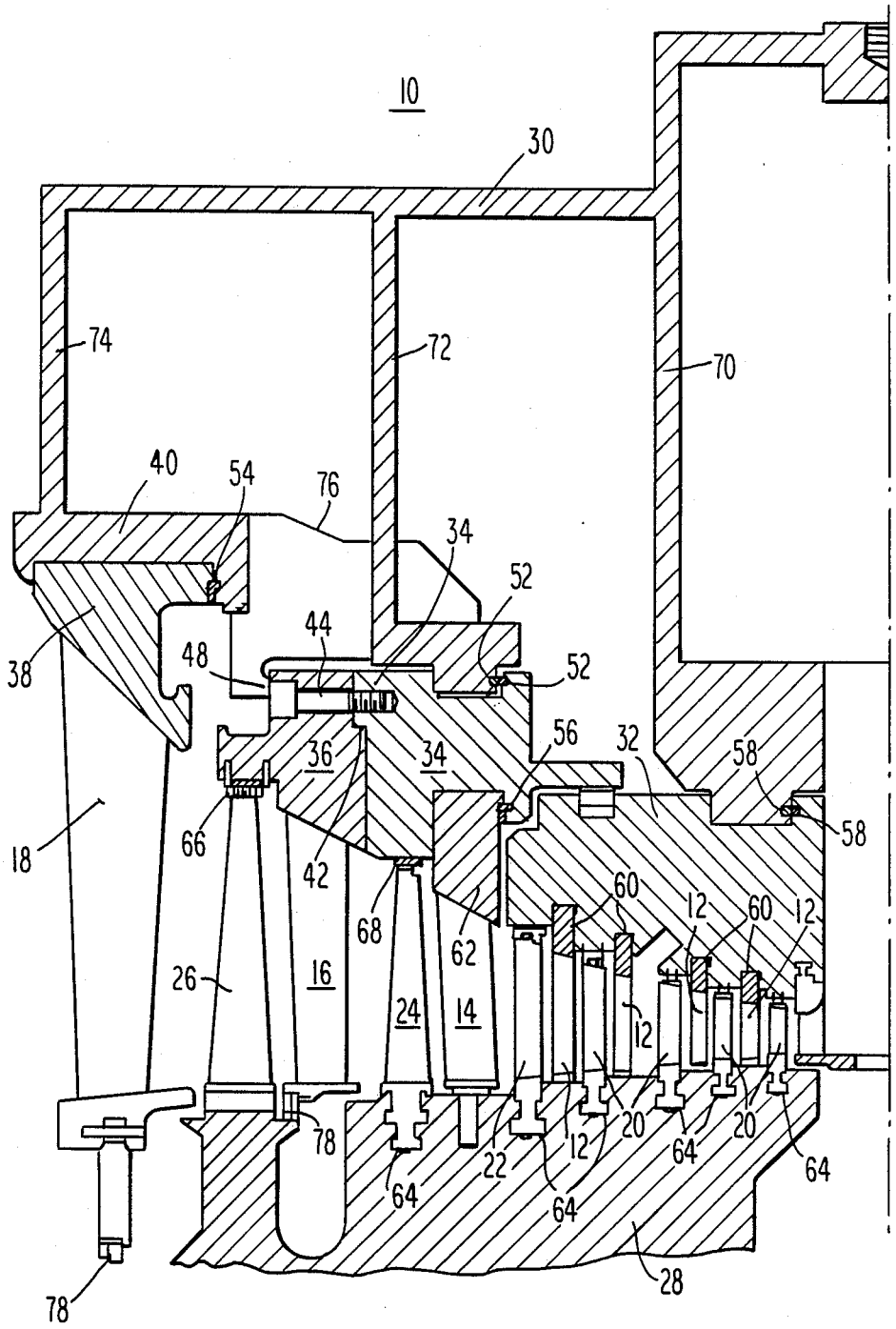
FIG. 1 is an axial cross section of an upper left hand quadrant portion of one end of a typical low pressure steam turbine using the apparatus of the present invention.
Figure 2:
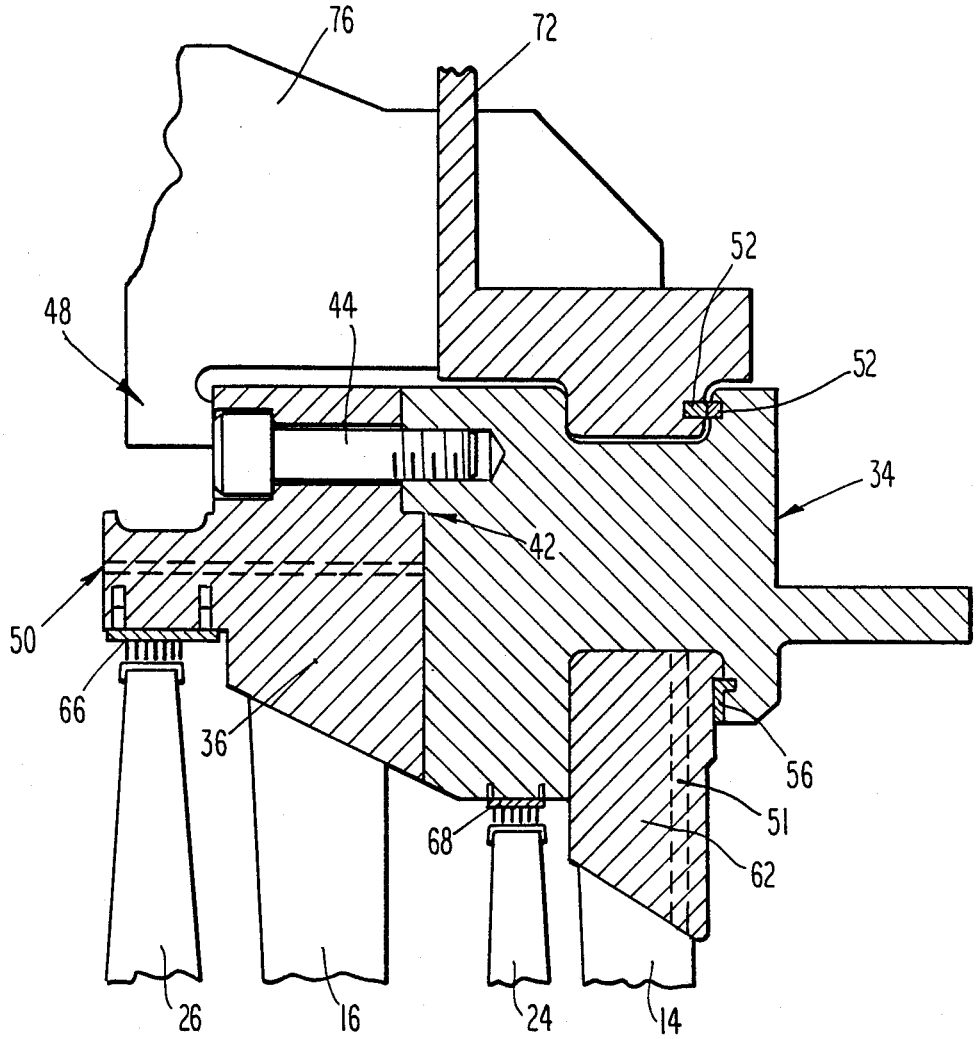
FIG. 2 is an enlarged view of a portion of FIG. 1, particularly showing elements of the present invention.

Turning in detail to the drawings, wherein like numbers indicate like members throughout, FIGS. 1 and 2 illustrate a typical axial cross section of an upper left-hand quadrant of a low pressure steam turbine 10. Such a typical turbine 10 includes an inner casing 30 comprised of an upper and a lower half. Such an inner casing 30 surrounds a central core of the turbine comprised of a rotor 28 with a series of attached (using roots 64) rotating blades 20, 22, 24 and 26. Also enclosed within the inner casing 30, but attached, either directly or indirectly using radial walls 70, 72 and 74, to the inner casing 30, is a series of stationary blades 12, 14, 16, and 18 attached to stationary blade rings 32, 34, 36, and 38. To minimize steam leakage past the tips of the blades, both the blade rings 32, 34, 36 and 38 and the rotor 28 are typically equipped with seals that interface with the blades. Such seals can be of any variety known to those skilled in the art, e.g. labyrinth seals 66 and 68 or spring-back blade seals 78.

The radial walls 70, 72, and 74 act as extraction steam channel walls. Upstream stationary blades 12, are typically attached using roots 60 to a separate stationary blade ring 32 which is separately supported by a tongue and groove fit with support keys and alignment dowels (not shown) to the inner casing 30 through radial wall 70. A pair of monel sealing strips 58 made of a more durable metal than the typical carbon steel, one fitted to the tongue and one fitted to the groove, help to prevent wear. Such a method of fitting isolates these upstream stationary blades 12 from problems of thermal deformation caused by non-axisymmetric thermal deformation of the inner casing.

At the downstream end of the turbine 10, stationary blades such as 18 are too large to attach in separate blade rings and, thus, are directly attached to the inner casing via radial wall 74 and an integral ring 40 connected to a fixed stationary blade ring 38 typically equipped with caulking strips 54. Being directly attached, such blade rings 38 are subject to the problems of thermal deformation discussed above. It would be preferable to minimize the number of stationary blade rings, and thereby stationary blades subject to such deformation. At this end, however, as mentioned, space problems restrict the ability to construct separate stationary blade rings. The apparatus of the present invention accomplishes the isolation of a stationary blade ring 36 from the thermal deformations of the system without requiring the space needed for the construction of a separate blade ring.

A downstream stationary blade ring 36 of the type that is normally locked into a groove in the inner cylinder casing 18 by caulking strips is fitted to the next adjacent upstream separate stationary blade ring 34, having a root 62 attached with caulking strips 56 and a stationary blade 14. (As with ring 32, ring 34 is separately supported by a tongue and groove fit and monel sealing strips 52 to a casing rib 72.) The fitting between the two rings 36 and 34 can be a spigot fit 42, or any other variation of fittings known to those of ordinary skill in the art that would maintain the relative position of the two rings 36 and 34. The downstream stationary blade ring 36 is then attached to the adjacent separate blade ring 34 by connection bolting 44. Such connection bolting 44 is typically equipped with substantial locking welds and can be readily removed for servicing. In addition to this connection bolting 44, which would normally have a clearance between it and the bolt hole, interface alignment dowels or pins and support keys (not shown) between the same two rings 36 and 34 are used to carry shear loads due to torsion that is applied to the downstream stationary blade ring 36 through the stationary blading 16.

Utilizing this system, the downstream stationary blade ring 36 is effectively isolated from any thermal deformations of the inner casing 30. Additional optional features can include a safety stop 48, located in conjunction with a series of ribs 76 connecting built-in blade ring 40 and separate blade ring 34, to maintain the axial position of the downstream stationary blade ring 36 should the connecting bolts 44 fail or loosen. Another option involves the use of steam sealing keys 50 located at the horizontal joint gaps of the downstream stationary blade ring 36. The steam sealing keys 50 are oriented 90° from the normal radial direction of typical prior art steam sealing keys because of the new configuration of the present invention. Such steam sealing keys 50 are typically necessary because the upper and lower halves of the various stationary blade rings are not bolted together. Only the upper and lower portions of the inner casing 30 are bolted. Therefore, a gap often exists between the upper and lower portions of stationary blade rings that can be closed using a steam sealing key 50. Steam sealing keys are normally located radially to stop axial leakage at the horizontal plane as illustrated by sealing key 51 in FIG. 2. In the apparatus of the present invention, however, separate stationary blade ring 34 would act to block axial steam leakage. (Steam sealing keys can also be eliminated by reducing the clearance between the top and bottom halves of the stationary blade rings.) When used, steam sealing keys are typically made of a strip of steel.

Use of the apparatus of the present invention has the primary function of isolating a stationary blade ring 36 from the thermal deformation stresses of the inner casing 30. In addition to this primary advantage, however, the present invention also reduces seal leakage as just discussed leading to higher efficiency as well as simplifying blade servicing. Rather than having to remove the caulking normally used with such a blade ring, all that is required is the backing out of the connection bolting 44.

The apparatus of the present invention has been described and shown for fossil application in a turbine having a single inner casing. The invention, however, is also applicable to nuclear units and to low pressure turbine units with single or double inner casings and single or multiple flow. It should be noted that not all low pressure turbines can benefit from the present invention, because its use depends on the blade path arrangement. The blade path arrangement is widely variable between various turbines, and, therefore, use of the present invention will depend upon the particular design utilized.

Thus, a system for minimizing thermal distortion of particular stationary blade rings in a turbine is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. In a steam turbine having at least one inner casing, each inner casing having a plurality of stages comprising alternating rotating blades extending from an axially oriented rotor and stationary blades extending axially radially inwardly from a blade ring within said inner casing of said turbine, a system for minimizing thermal deformation of a blade ring comprising:

an upstream stationary blade ring separately supported to said inner casing;

a downstream stationary blade ring, fit with said upstream stationary blade ring to maintain a relative position of said upstream and downstream blade rings and supported by said upstream stationary blade ring; and a plurality of connection bolting between said rings capable of supporting said downstream stationary blade ring in the axial direction.

2. The system of claim 1 further comprising:

a plurality of pins between said rings capable of carrying shear loads due to torsion applied to said downstream stationary blade rings.

3. The system of claim 1 wherein the fit between the two blade rings is a spigot fit.

4. The system of claim 1 wherein said downstream stationary blade ring has an upper and a lower half separated by horizontal joint gaps and further comprising:

a plurality of steam sealing keys located at the horizontal joint gap of said downstream stationary blade ring and oriented perpendicular to the radial direction and parallel to the axial direction.

5. The system of claim 1 further comprising:

a safety stop attached to an inner casing rib system capable of maintaining the axial position of the downstream stationary blade ring in the event of connection bolting failure.

6. The system of claim 1 wherein the upstream stationary blade ring is supported to said inner casing by a tongue and groove fit with alignment dowels and support 7. The system of claim 1 wherein the turbine is a nuclear turbine.

8. The system of claim 1 wherein the turbine is a fossil fuel powered turbine.

9. A steam turbine comprising:

a rotor having a plurality of radially extending rotating blades;

an inner casing surrounding said plurality of rotating blades;

a plurality of radially inwardly extending stationary blades attached to a plurality of stationary blade rings;

at least one of said stationary blade rings comprising an upstream ring separately supported to said inner casing; and at least one of said stationary blade rings comprising a downstream ring fit with one of said upstream rings to maintain a relative position of said upstream and downstream blade rings and supported by said upstream blade ring.

10. The turbine of claim 9 wherein said downstream blade rings are supported by said upstream blade rings using a plurality of connection bolting and a plurality of pins between said blade rings capable of carrying shear loads due to torsion on said downstream blade rings.

11. The turbine of claim 9 wherein the fit between an upstream blade ring and a downstream blade ring is a spigot fit.

12. The turbine of claim 9 wherein said downstream stationary blade rings have upper and lower halves separated by horizontal joint gaps and further comprising;

a plurality of steam sealing keys located at the horizontal joint gaps of said downstream stationary blade rings and oriented perpendicular to the radial direction and parallel to the axial direction.

13. The turbine of claim 9 further comprising:

a plurality of safety stops attached to an inner casing rib system capable of maintaining the axial position of one of said downstream stationar blade rings in the event of connection bolting failure.

14. The turbine of claim 9 wherein the upstream stationary blade rings are supported to said inner casing by a tongue and groove fit with alignment dowels and support keys.

15. The turbine of claim 9 wherein the turbine is nuclearly operated.

16. The turbine of claim 9 wherein the turbine is fossil fuel powered.

* * * * *